United States Patent [19]

Perovetz et al.

[11] Patent Number: 4,832,743

[45] Date of Patent: May 23, 1989

[54] GOLD PLATING SOLUTIONS, CREAMS AND BATHS

[75] Inventors: Lawrence M. Perovetz, Stanmore; Jack Pickthall, deceased, late of Angmering-On-Sea, both of England; by Terence Pickthall, executor, Colchester, United Kingdom

[73] Assignee: Lamerie, N.V., St. Helier, Netherlands

[21] Appl. No.: 944,333

[22] Filed: Dec. 19, 1986

[51] Int. Cl.[4] ..... C23C 3/02

[52] U.S. Cl. ..... 106/1.23; 106/1.26; 106/1.05; 106/3

[58] Field of Search ..... 106/1.26, 1.23, 3; 252/105; 427/443.1, 437; 51/293, 307–309

[56] References Cited

U.S. PATENT DOCUMENTS

| | | | |
|---|---|---|---|
| 27,425 | 3/1860 | Brockett | 106/3 |
| 111,945 | 2/1871 | Keane | 106/3 |
| 1,208,507 | 12/1916 | Dalby | 106/1 |
| 2,501,737 | 3/1950 | Porter | 106/1 |
| 2,836,515 | 5/1958 | McNally | 117/130 |
| 2,976,181 | 3/1961 | Brookshire | 117/130 |
| 3,032,436 | 5/1962 | Gostin | 117/71 |
| 3,123,484 | 3/1964 | Pokras | 106/1 |
| 3,123,784 | 3/1964 | Pokras | 106/1 |
| 3,230,098 | 1/1966 | Robinson | 106/1 |
| 3,266,929 | 8/1986 | Lareau | 117/130 |
| 3,294,578 | 12/1966 | Popeck | 117/130 |
| 3,300,328 | 1/1967 | Luce | 117/47 |
| 3,396,042 | 8/1968 | Duva | 106/1 |
| 3,425,947 | 2/1969 | Rausch | 252/105 |
| 3,468,676 | 9/1969 | Schneble | 106/1 |
| 3,589,916 | 6/1971 | McCormack | 106/1 |
| 3,700,469 | 10/1972 | Okinaka | 106/1 |
| 3,754,878 | 8/1973 | Burke | 51/307 |
| 3,960,573 | 6/1976 | Zeblisky | 106/1 |
| 3,992,211 | 11/1976 | Skoll | 106/1 |
| 4,091,128 | 5/1978 | Franz | 427/304 |
| 4,142,902 | 3/1979 | Burke | 106/123 |
| 4,270,932 | 6/1981 | Perovetz et al. | 51/293 |
| 4,307,136 | 12/1981 | Prost-Tournier | 427/443.1 |
| 4,337,091 | 6/1982 | El-Shazly | 106/1.23 |
| 4,352,690 | 10/1982 | Dettke | 106/1.23 |
| 4,374,876 | 2/1983 | El-Shazly | 427/443.1 |
| 4,474,838 | 10/1984 | Halecky | 427/436 |
| 4,481,035 | 11/1984 | Andrascek | 106/1.23 |

FOREIGN PATENT DOCUMENTS

| | | | |
|---|---|---|---|
| 482895 | 5/1917 | France | 8/3 |

OTHER PUBLICATIONS

Payne, "Art Metalwork With Inexpensive Equipment", page 37.

Schwahn, "Workshop Methods for Gold—and Silversmiths", (1960), page 109.

*Primary Examiner*—Josephine Barr

[57] ABSTRACT

Non-toxic, non-electrolytic solutions, creams and immersion baths are provided for gold plating metallic items such as silver, copper, nickel, brass and gold alloys, as well as silver plated or gold plated items. Water soluble gold salts are used, together with reducing compounds. For convenience, the gold plating ingredients may be combined with salts to form tablets or powders. Addition of water to the tablets or powder provides the novel solutions and immersion baths. The amount of gold generating compound in the solutions and creams is selected to either replenish or maintain the amount of gold on an item which already has a gold surface.

38 Claims, No Drawings

GOLD PLATING SOLUTIONS, CREAMS AND BATHS

BACKGROUND OF THE INVENTION

The invention relates to non-toxic, non-electrolytic solutions, creams and baths for plating gold onto metallic items such as silver, copper, brass, nickel and gold alloys, as well as onto items which have been previously silver plated or gold plated. The solutions and creams are particularly useful for consumers, because they are easy to use and non-toxic. The baths are particularly useful in industry for gold plating such products as computer and electronic components, as well as for manufacturing jewelers. They may also be used to convert silver jewelry into gold plated jewelry in the home. The baths do not require expensive electrolytic plating equipment. Solutions and creams are also provided which polish as well as gold plate metallic items.

DESCRIPTION OF THE PRIOR ART

Various methods exist for the plating of metallic objects with gold. Electrolytic plating has long been used, but is impractical for consumer use, and is costly and requires special precautions for industrial use. Electroless plating methods most commonly involve the use of compositions which contain a cyanide compound. Cyanide compounds present problems with toxicity which render them unsuitable for consumer use and require precautions for industrial use. Other methods involve the use of amines which have an unpleasant odor and may also present toxicity problems.

Some methods require cleaning of the object prior or subsequent to plating with gold. Such two-step procedures are inconvenient and time-consuming. Still other methods require pretreatment such as activation or sensitization of the surface to be plated. Additional methods require the plating to be carried out at greater than ambient temperatures. All of these methods are impractical or time-consuming for consumer use and involve extra expense for industrial use.

SUMMARY OF THE INVENTION

Accordingly, it is an object of this invention to provide non-toxic solutions which may be applied directly to metal items to gold plate the items. The items may be a metal such as silver, copper, brass, nickel or gold alloy, as well as previously silver plated or gold plated items. Another object of this invention is to provide non-toxic solutions which may be applied directly to silver plated items to simultaneously gold plate and polish the items to remove any dirt or tarnish present.

A further object of this invention is to provide non-toxic plating and polishing solutions which will, even with a reduced gold component level, maintain the level of gold plating on items; that is, the solutions restore at least the amount of gold that is removed by the simultaneous polishing operation.

An additional object of this invention is to provide non-toxic creams which may be applied directly to the same types of metal items as with the inventive solutions in order to gold plate the items.

Yet another object of this invention is to provide non-toxic creams which simultaneously gold plate and polish the items. The gold component level can be adjusted so as to either maintain or restore the amount of gold plated on the items.

Yet another object of this invention is to provide non-toxic immersion baths which gold plate the same types of metal items as with the inventive solutions and creams. A further object of this invention is to use the baths to gold plate computer and electronic components and for use by manufacturing jewelers. Yet another object is to use the baths to convert silver jewelry into gold plated jewelry in the home.

Still another object of this invention is to provide concentrates, such as tablets, powders or liquids which, when mixed with water, form solutions and baths for gold plating.

These gold plating solutions and baths may be applied in a single step at ambient temperatures, without electricity or the need for a separate cleaning step or pretreatment of the item to be plated, without the use of cyanide or other toxic compositions and without the use of malodorous amine compounds.

These objects are achieved by the novel solutions, creams and baths which will now be described.

DETAILED DESCRIPTION OF THE INVENTION

The inventive solutions, creams and baths are used to apply thin, pure gold plating to a variety of metallic surfaces. The inventive compositions may be applied to base metals such as copper, nickel and brass to transform them into gold plated objects. Because the gold is not alloyed with a base metal, the resulting surfaces have an attractive, shiny gold covering.

The inventive compositions may also be applied to silver or silver plated items, including jewelry, to convert them into gold jewelry and enhance their appearance. Even gold or gold plated objects benefit by treatment with the inventive compositions. Objects are rarely composed of pure gold. Instead, gold is commonly alloyed with copper. The gold content is expressed in terms of carats, which is defined as the number of parts of gold in 24 parts of alloy. Application of the inventive compositions results in the plating of pure gold on top of a gold-copper alloy, producing a more pleasing color and shine.

Most gold items such as jewelry have a gold content of under 18 carats. A tyupical 14 carat item may have a thin 22 or 24 carat coating to improve its appearance. However, handling of the item will eventually cause the thin plating to wear off, exposing the underlying gold-copper alloy. Furthermore, over time, the surfaces of gold plated objects may become dirty or tarnished. Conventional polishes remove the dirt and tarnish, but also remove some of the gold. Eventually, the thin gold plating is worn off.

The inventive solutions and creams restore the fine gold appearance of such items. The solutions and creams may contain polishing agents to remove dirt and tarnish. However, they are formulated to deposit more gold than is removed by polishing. In this way, a long-lasting layer of gold plating may be built up with repeated applications. Thereafter, the level of gold plating may be maintained by use of solutions and creams having a lower gold content, which effects a cost saving.

Specifically, applicants have found that hard metallic items such as copper, nickel and brass, precious metals such as silver and gold alloys, as well as items previously plated with silver and gold, can be plated with gold by the use of aqueous solutions which contain a gold generating compound and a reducing compound for the gold generating compound.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaruate, sodium tetraiodoaurate and sodium thiosulfatoaurate. In a preferred embodiment, potassium tetrachloroaurate is used.

The reducing compound is potassium sodium tartrate, potassium hydrogen tartrate or tartaric acid. In a preferred embodiment, potassium sodium tartrate is used. Although potassium hydrogen tartrate is not water-soluble, it may be suspended by the other ingredients. It is not necessary for the solution to be homogeneous for gold plating to take place because of its application by hand to the item to be plated.

Applicants have found that the plating of the inventive solutions may be further improved through the addition of a humectant and a polyoxyalkylene ester surfactant.

The humectant is selected from the group consisting of dipropylene glycol, diethylene glycol and triethylene glycol and serves as a wetting agent to increase the penetration of the plating ingredients. In a preferred embodiment, dipropylene glycol is used. Two or more of these compounds may also be used in combination.

A variety of polyoxyalkylene ester compounds are commercially available for use as surfactants such as polyoxyalkylene sorbitan fatty esters. In a preferred embodiment, the addition product of 20 moles of ethylene oxide with sorbitan oleate known as Tween 80 is used.

Although gold tarnishes at a much slower rate than silver when exposed to sulfur, over time some tarnishing may become noticeable. Therefore, it may be useful to include a polishing agent in the formulation. A polishing agent is also of value if gold plating is to be applied to a surface of tarnished silver. The polishing agent serves to remove any surface dirt and blemishes on the item to be gold plated. The polishing agent will be a diatomaceous earth. In a preferred embodiment, the diatomaceous earth is Kieselguhr. Particularly useful is the grade of Kieselguhr known as Dicalite 104.

The above ingredients are mixed with water to form a solution. Preferably, the water is distilled or deionized. The solution is then packaged for sale to the user, who may apply the solution directly to the metallic item to be gold plated without any mixing or handling steps. To reduce package size, the solution may be supplied in concentrated liquid form. The user would simply add water as directed, mix and apply in the usual fashion.

During storage, the polishing agent will tend to precipitate out of solution. A suspending compound may be used to maintain the polishing agent in solution. In a preferred embodiment, the suspending agent is propylene glycol. Although propylene glycol is a glycol, it is a far less effective wetting agent than those described previously and should not be used as the sole wetting agent in the solution. However, by maintaining the diactomaceous earth in solution, the propylene glycol serves to improve the polishing properties of the solution.

In some instances, the solutions may be turbid or cloudy. It has been found that the addition of common salts such as sodium chloride, potassium chloride, sodium bromide, potassium bromide, sodium iodide and potassium iodide serves to remove the turbidity and clear up the solutions. The use of sodium chloride is preferred.

In an alternative embodiment, the gold plating ingredients of the solution may be supplied in concentrated tablet or powder form. Common salts such as sodium chloride, potassium chloride, sodium bromide, potassium bromide, sodium iodide and potassium iodide may be used as dilutents and binders which are mixed with the active ingredients and formed into tablets or a powder. The use of sodium chloride is preferred. The user simply adds the tablet or powder to water to form the gold plating solution. In this embodiment, a suspending compound is not required. Furthermore, as described previously, the common salt serves to eliminate turbidity and clear up the solution.

When applied to a metal such as silver, copper, nickel or brass, the novel solution quickly and easily lays down a layer of gold plating which is believed to bond directly to the surface of the item. This may be referred to as molecular plating, in contrast to electroplating. The solution penetrates through any dirt or tarnish to act directly upon the surface of the item. Inclusion of a polishing agent will result in the simultaneous removal of dirt and tarnish. The surface need not be cleaned, pre-treated or sensitized in order for the plating of gold to take place.

In another embodiment of the invention, use of a smaller concentration of gold in the solution may be used to maintain, but not necessarily replenish, the amount of gold plating on an item. Such a solution will be less costly, owing to the significantly smaller amount of expensive gold needed.

In still another embodiment of the invention, the gold plating compositions are in the form of creams, rather than solutions. As with the solutions, the creams are non-toxic, require no preparative steps by the user and may be applied at ambient temperatures directly to the metallic object to be plated.

The creams contain a gold generating compound, a reducing compound for the gold generating compound, an emulsifier, a humectant and water. Although the creams need not contain additional ingredients, ordinarily a polishing agent and a common salt will also be included.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaruate, sodium tetraiodoaurate and sodium thiosulfatoaurate. In a preferred embodiment, potassium tetrachloroaurate is used.

The reducing compound is potassium sodium tartrate, potassium hydrogen tartrate or tartaric acid. In a preferred embodiment, potassium sodium tartrate is used. Although potassium hydrogen tartrate is not water-soluble, it may be suspended by the other ingredients. It is not necessary for the cream to be homogeneous for gold plating to take place because of its application by hand to the item to be plated.

Alcohols are used as emulsifiers for the creams. In particular, a variety of long chain alcohols may be used, such as cetyl alcohol, the high molecular weight alcohol which is 10% sulfated known as Lanette Wax SX, tetradecyl trimethyl ammonium bromide (known as cetrimide) or the cetyl alcohol condensed with 20 ethylene oxide units known as Empilan KM20. In a preferred embodiment, Lanette Wax SX is used.

The humectant is selected from the group consisting of dipropylene glycol, diethylene glycol and triethylene glycol and serves as a wetting agent to increase the penetration of the plating ingredients. In a preferred embodiment, dipropylene glycol is used. Two or more of these compounds may also be used in combination.

The polishing agent will be a diatomaceous earth. In a preferred embodiment, the diatomaceous earth is Kieselguhr. Particularly useful is the grade of Kieselguhr known as Dicalite 104. The common salt will be one such as sodium chloride, potassium chloride, sodium bromide, potassium bromide, sodium iodide and potassium iodide. The use of sodium chloride is preferred.

The above ingredients are mixed with water to form a cream. Preferably, the water is distilled or deionized. The cream is then packaged for sale to the user, who may apply the cream directly to the object to be plated without any mixing or handling steps.

In a further embodiment of the invention, the amount of the gold generating compound in the cream may be reduced so as to maintain, but not necessarily replenish, the amount of gold plating on an item.

In another embodiment of the invention, the gold plating compositions are in the form of immersion baths, rather than solutions or creams. The baths include a gold generating compound and a reducing compound for the gold generating compound. As with the solutions, the baths are non-toxic and require no preparative steps. The user simply immerses the metallic item to be gold plated in the bath at ambient temperatures. The metallic item can be silver, copper, nickel, brass or gold alloy, or can be previously silver plated or gold plated. As discussed below, the bath formulations may also be supplied in concentrated form, such as tablets, powders or liquids.

The gold generating compound is a non-toxic, water soluble gold salt. Examples of such gold salts are potassium tetrachloroaurate, potassium tetrabromoaurate, potassium tetraiodoaurate, sodium tetrachloroaurate, sodium tetrabromoaruate, sodium tetraiodoaurate and sodium thiosulfatoaurate. In a preferred embodiment, potassium tetrachloroaurate is used.

The reducing compound is potassium sodium tartrate or tartaric acid. In a preferred embodiment, potassium sodium tartrate is used. Potassium hydrogen tartrate is not water soluble and should not be used in the immersion bath. There are no ingredients present to put it in suspension. Furthermore, a suspension would make the bath non-homogeneous. This is to be avoided, because the item to be plated is merely immersed in the bath, rather than having the plating ingredients rubbed onto the item, as is the case with solutions or creams. Therefore, a homogeneous bath is necessary to ensure even plating on the surface of the item.

As with the solutions, it has been found that, in some instances, the baths may be turbid or cloudy. The addition of common salts such as sodium chloride, potassium chloride, sodium bromide, potassium bromide, sodium iodide and potassium iodide serves to remove turbidity and clear up the baths. The use of sodium chloride is preferred.

Although the gold generating compound and the reducing compound may be mixed with water, packaged and sold, the volume of water needed for an immersion bath makes the sale of the finished bath cumbersome. It is preferred to supply the gold plating ingredients of the bath in concentrated form. In one embodiment, the composition is supplied in tablet or powder form. Common salts such as sodium chloride, potassium chloride, sodium bromide, potassium bromide, sodium iodide and potassium iodide may be used as dilutents and binders which are mixed with the active ingredients and formed into tablets or powders. In a preferred embodiment, sodium chloride is used. Furthermore, as described previously, the common salt serves to eliminate turbidity and clear up the bath. In another embodiment, the bath is supplied in concentrated liquid form.

The user will add water, preferably distilled or deionized, to a tank or other holding chamber. The concentrate, in the form of a tablet, powder or liquid, is added to the water and mixed to form the plating bath. If the bath is allowed to stand, some precipitate will form. This precipitate may be removed by filtration, leaving the bath able to gold plate as readily as when the bath was freshly prepared.

It is anticipated that a major use for the inventive bath will be to gold plate metallic items for use as computer and electronic components. In such instances, the items will be free of tarnish and without dirt or blemishes. However, plating will still occur even if the surface of the item is not clean.

The user will immerse the item to be plated in the bath. After a short immersion time, the item is removed and dried. The item will have been gold plated without the need for elaborate equipment or procedures.

The use of tartaric acid and its salts as reducing compounds provides an acidic environment for the solutions and baths. It has been found that if alkali is added so as to make the solutions and baths basic, then plating of gold will not occur.

The amount of gold generating compound needed to provide the desired plating in solutions, creams or baths will vary from formulation tested and also according to whether a solution, cream or bath is used. However, for a given formulation, the user can establish by a few simple tests the effective amount of gold generating compound.

The following examples present illustrative but non-limiting embodiments of the present invention.

EXAMPLE 1

A one percent solution of potassium tetrachlororuate (GTCK) in water was made and then a small amount of potassium hydrogen tartrate was stirred in. The solution was applied to a copper surface that had previously been plated with silver. After drying, the surface was gently polished with a soft cloth. The solution produced a thin gold covering on the surface.

EXAMPLE 2

Three solutions were prepared from the following components, all parts by weight:

| | A | B | C |
|---|---|---|---|
| GTCK | 1.0 | 1.0 | 1.0 |
| Potassium hydrogen tartrate | 4.0 | — | — |
| Tartaric acid | — | 0 4 | 0.4 |
| Dicalite 104 | 10.0 | 10.0 | — |
| Water | 50.0 | 50.0 | 50.0 |

The solutions were each applied to a silvered surface following the procedure of Example 1. Solution A gave a very good cover with golden color. Solution B gave similar results with a little more yellow color. Solution C gave a weaker cover with a little more yellow color.

EXAMPLE 3

A solution was prepared from the following components, all parts by weight:

| | |
|---|---|
| GTCK | 2.0 |
| Potassium hydrogen tartrate | 6.0 |
| Dipropylene glycol | 3.0 |
| Tween 80 | 0.5 |
| Dicalite 104 | 25.0 |
| Water | 100.0 |

The solution was applied to a silver plated copper surface following the procedure of Example 1. The solution produced a very good gold covering on the surface.

EXAMPLE 4

Solutions were prepared using various amounts of GTCK together with the following components by weight: potassium hydrogen tartrate - 6.0, dipropylene glycol -3.0, Tween 80 - 0.5, Dicalite 104 - 25.0, water - 100.0. The amounts of GTCK in the solutions are set forth below in weight percent, together with the results when the procedure of Example 1 was followed.

| GTCK | Result |
|---|---|
| 0.062 & 0.125 | Tinge of gold cover - these solutions would be useful as gold maintenance solutions |
| 0.25 | Quite good cover, yellowish |
| 0.50 | Very good cover |
| 1.0, 1.5 & 2.0 | Very good cover, slightly superior to 0.5 |
| 3.2 | Slightly darker gold than 2.0 |

EXAMPLE 5

Three solutions were prepared from the following components, all parts by weight:

| | D | E | F |
|---|---|---|---|
| GTCK | 1.0 | 1.0 | 1.0 |
| Potassium hydrogen.tartrate | 2.5 | — | — |
| Potassium sodium tartrate | — | 2.5 | — |
| Tartaric acid | — | — | 2.5 |
| Dipropylene glycol | 3.0 | 3.0 | 3.0 |
| Tween 80 | 0.5 | 0.5 | 0.5 |
| Dicalite 104 | 17.5 | 17.5 | 17.5 |
| Water | 75.5 | 75.5 | 75.5 |

The solutions were each applied to a silvered surface following the procedure of Example 1. All three solutions gave very good cover with a gold shade. Solution E was slightly superior in providing a shiny surface.

EXAMPLE 6

Four solutions were prepared to illustrate the effect of pH on the ability to gold plate a surface. The solutions consisted of the following components, all parts by weight: GTCK - 1.0, dipropylene glycol - 2.0, Tween 80 - 1.0, Dicalite 104 - 17.5, propylene glycol -3.0, water - 70.5, together with the reducing compounds set forth below, all parts by weight:

| | G | H | I | J |
|---|---|---|---|---|
| Potassium hydrogen tartrate | 5.0 | — | — | — |

-continued

| | G | H | I | J |
|---|---|---|---|---|
| Potassium sodium tartrate | — | 5.0 | — | 5.0 |
| Tartaric acid | — | — | 5.0 | — |
| Sodium carbonate | — | — | — | 2.0 |
| pH (approximate) | 3.5 | 6.0 | 1.5 | 10.0 |

The solutions were each applied to a silver plated copper surface following the procedure of Example 1. Solutions G and I gave strong cover with a medium yellow color. Solution H gave a less strong cover with a pale yellow color. Solution J did not provide any gold plating cover to the surface at all.

EXAMPLE 7

A solution was prepared from the following components, all parts by weight:

| | |
|---|---|
| GTCK | 1.5 |
| Potassium hydrogen tartrate | 5.0 |
| Dipropylene glycol | 2.0 |
| Tween 80 | 1.0 |
| Dicalite 104 | 18.0 |
| Propylene glycol | 3.0 |
| Water | 69.5 |

Portions of the solution were applied separately to a silver plated copper surface, a clean copper surface and a soiled copper surface following the procedure of Example 1. The solution gave an excellent gold cover on the silver plated copper surface, and good gold cover on both the clean and soiled copper surfaces.

EXAMPLE 8

A solution was prepared from the following components, all parts by weight:

| | |
|---|---|
| GTCK | 0.5 |
| Potassium sodium tartrate | 2.5 |
| Dipropylene glycol | 4.0 |
| Tween 80 | 0.8 |
| Dicalite 104 | 18.0 |
| Water | 74.2 |

The solution was applied to a silvered surface following the procedure of Example 1. The solution gave an excellent gold surface.

EXAMPLE 9

A solution was prepared from the following components, all parts by weight:

| | |
|---|---|
| GTCK | 0.1 |
| Potassium sodium tartrate | 2.5 |
| Dipropylene glycol | 4.0 |
| Tween 80 | 0.8 |
| Dicalite 104 | 18.0 |
| Water | 74.6 |

This solution, which contained less gold generating compound than Example 8, was applied to a silvered surface following the procedure of Example 1. The solution added a thin gold cover and would be useful as a maintenance solution for previously gold plated items.

EXAMPLE 10

A cream was prepared from the following components, all parts by weight:

| | |
|---|---|
| GTCK | 1.0 |
| Potassium sodium tartrate | 5.0 |
| Lanette wax SX | 15.0 |
| Dipropylene glycol | 4.0 |
| Dicalite 104 | 18.0 |
| Sodium chloride | 7.0 |
| Water | 58.0 |

The cream was applied as a thin layer to a nickel surface that had been electroplated with silver. The surface was rubbed with a soft cloth. The cream produced a fine gold covering on the surface.

EXAMPLE 11

A bath was prepared from the following components, all parts by weight:

| | |
|---|---|
| GTCK | 1.0 |
| Potassium sodium tartrate | 2.0 |
| Water | 97.0 |

A silver plated copper item was immersed in the bath for 10 seconds, then removed. A strong, pleasant gold surface was visible. The item was immersed in the bath for a further 20 seconds. The surface took on some black color, which easily rubbed off with a soft cloth to leave a very good gold surface. The item was immersed a third time for a further 30 seconds. The surface took on a dark background which again rubbed off to leave a strong gold surface.

EXAMPLE 12

Sodium chloride was added to the bath of Example 11. The sodium chloride did not affect the gold plating of the bath, but did reduce the amount of blackening. After 30 seconds of immersion no blackening was visible, and even after 5 minutes the small amount of blackening was easily rubbed off to leave a fine gold surface.

EXAMPLE 13

A tablet was prepared from the following components, all parts by weight:

| | |
|---|---|
| GTCK | 1 |
| Potassium sodium tartrate | 2 |
| Sodium chloride | 7 |

Five grams of the tablet were dissolved in 50 ml of water to form the plating bath. A silver plated item was immersed in the bath for 60 seconds, then removed. The surface had a small amount of black color, which easily rubbed off with a soft cloth to leave an excellent gold surface.

EXAMPLE 14

The bath prepared in Example 13 was allowed to stand for 48 hours. A small amount of precipitate had formed which was removed by filtration. A silver plated item was immersed in the bath for 60 seconds, then removed. The gold plating was just as good as with the original, freshly-made bath.

EXAMPLE 15

A bath was prepared following the procedure of Example 13. A nickel plated item was immersed in the bath, then removed. A gold plated surface was visible. However, immersion of a pure nickel item did not result in gold plating. The pH of the bath was then reduced to 1.0, which resulted in gold plating of the pure nickel item after immersion.

We claim:

1. A non-toxic solution for gold plating metallic items such as silver, copper, nickel, brass or gold alloys, or silver plated or gold plated metallic items comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is selected from the group consisting of potassium sodium tartrate, potassium hydrogen tartrate and tartaric acid; and (3) water.

2. The solution of claim 1 wherein the water soluble gold salt is potassium tetrachloroaurate and the reducing compound is potassium sodium tartrate.

3. The solution of claim 1 which further comprises an effective amount of a diatomaceous earth as a polishing component.

4. The solution of claim 3 which further comprises an effective amount of a compound to maintain the diatomaceous earth in suspension in the solution.

5. The solution of claim 4 wherein the diatomaceous earth is Kieselguhr and propylene glycol is used to maintain the Kieselguhr in suspension in the solution.

6. The solution of claim 1 which further comprises effective amounts of a polyoxyalkylene ester surfactant and a humectant selected from the group consisting of diethylene glycol, dipropylene glycol and triethylene glycol.

7. The solution of claim 6 wherein the polyoxyalkylene ester surfactant is the addition product of 20 moles of ethylene oxide with sorbitan oleate and the humectant is dipropylene glycol.

8. The solution of claim 6 which further comprises an effective amount of a diatomaceous earth as a polishing component.

9. The solution of claim 8 which further comprises an effective amount of a compound to maintain the diatomaceous earth in suspension in the solution.

10. The solution of claim 9 wherein the diatomaceous earth is Kieselguhr and propylene glycol is used to maintain the Kieselguhr in suspension in the solution.

11. The solution of claim 9 which further comprises an effective amount of a salt to reduce turbidity which is selected from the group consisting of sodium chloride, potassium chloride, sodium bromide, potassium bromide, sodium iodide and potassium iodide.

12. The solution of claim 11 wherein the salt is sodium chloride.

13. A concentrate in tablet or powder form which when mixed with water provides a non-toxic solution for gold plating metallic items such as silver, copper, nickel, brass or gold alloys, or silver plated or gold plated metallic items, said tablet or powder comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is selected from the group consisting of potassium sodium tartrate, potassium hydrogen tartrate and tartaric acid; (3) a polyoxyalkylene ester surfactant; (4) a humectant selected from the group consisting of diethylene glycol, dipropylene glycol and triethylene glycol; and (5) a salt as a dilutent and binder which is selected from the group consisting of sodium chloride, potassium chloride, sodium bromide, potassium bromide, sodium iodide and potassium iodide.

14. The concentrate of claim 13 wherein the water soluble gold salt is potassium tetrachloroaurate, the reducing compound is potassium sodium tartrate, the polyoxyalkylene ester surfactant is the addition product of 20 moles of ethylene oxide with sorbitan oleate, the humectant is dipropylene glycol and the salt is sodium chloride.

15. The concentrate of claim 13 which further comprises an effective amount of a diatomaceous earth as a polishing component.

16. The concentrate of claim 15 wherein the diatomaceous earth is Kieselguhr.

17. A non-toxic solution for polishing and maintaining the amount of gold on a gold plated article, by restoring at least the amount of gold removed by that polishing, comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is selected from the group consisting of potassium sodium tartrate, potassium hydrogen tartrate and tartaric acid; (3) a polyoxyalkylene ester surfactant; (4) a humectant selected from the group consisting of diethylene glycol, dipropylene glycol and triethylene glycol; (5) a diatomaceous earth as a polishing agent; and (6) water.

18. The solution of claim 15 wherein the water soluble gold salt is potassium tetrachloroaurate, the reducing compound is potassium sodium tartrate, the polyoxyalkylene ester surfactant is the addition product of 20 moles of ethylene oxide with sorbitan oleate, the humectant is dipropylene glycol and the diatomaceous earth is Kieselguhr.

19. The solution of claim 18 which further comprises an effective amount of propylene glycol to maintain the Kieselguhr in suspension in the solution.

20. The solution of claim 18 which further comprises an effective amount of a salt to reduce turbidity which is selected from the group consisting of sodium chloride, potassium chloride, sodium bromide, potassium bromide, sodium iodide and potassium iodide.

21. The solution of claim 20 wherein the salt is sodium chloride.

22. A non-toxic cream for gold plating metallic items such as silver, copper, nickel, brass or gold alloys, or silver plated or gold plated metallic items comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is selected from the group consisting of potassium sodium tartrate, potassium hydrogen tartrate and tartaric acid; (3) an alcohol as an emulsifier; (4) a humectant selected from the group consisting of diethylene glycol, dipropylene glycol and triethylene glycol; and (5) water.

23. The cream of claim 19 wherein the water soluble gold salt is potassium tetrachloroaurate, the reducing compound is potassium sodium tartrate and the humectant is dipropylene glycol.

24. The cream of claim 19 which further comprises an effective amount of a diatomaceous earth as a polishing component.

25. The cream of claim 24 wherein the diatomaceous earth is Kieselguhr.

26. The cream of claim 23 which further comprises an effective amount of a salt which is selected from the group consisting of sodium chloride, potassium chloride, sodium bromide, potassium bromide, sodium iodide and potassium iodide.

27. The cream of claim 26 wherein the salt is sodium chloride.

28. A non-toxic cream for polishing and maintaining the amount of gold on a gold plated article, by restoring at least the amount of gold removed by that polishing, comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is selected from the group consisting of potassium sodium tartrate, potassium hydrogen tartrate and tartaric acid; (3) an alcohol as an emulsifier; (4) a humectant selected from the group consisting of diethylene glycol, dipropylene glycol and triethylene glycol; (5) a diatomaceous earth as a polishing agent; and (6) water.

29. The cream of claim 24 wherein the water soluble gold salt is potassium tetrachloroaurate, the reducing compound is potassium sodium tartrate and the diatomaceous earth is Kieselguhr.

30. The cream of claim 24 wherein the humectant is dipropylene glycol.

31. The cream of claim 24 which further comprises an effective amount of a salt which is selected from the group consisting of sodium chloride, potassium chloride, sodium bromide, potassium bromide, sodium iodide and potassium iodide.

32. The cream of claim 31 wherein the salt is sodium chloride.

33. A non-toxic immersion bath for gold plating metallic items such as silver, copper, nickel, brass or gold alloys, or silver plated or gold plated metallic items comprising effective amounts of: (1) a water soluble gold salt as a gold generating compound selected from the group consisting of potassium tetrachloroaurate, potassium tetrabromoaurate, potassium tetraiodoaurate, sodiumtetrachloroaurate, sodium tetrabromoaurate, sodium tetraiodoaurate and sodium thiosulfatoaurate; (2) a reducing compound for said gold generating compound which is potassium sodium tartrate or tartaric acid; and (3) water.

34. The immersion bath of claim 33 wherein the water soluble gold salt is potassium tetrachloroaurate and the reducing compound is potassium sodium tartrate.

35. The immersion bath of claim 33 which further comprises an effective amount of a salt to reduce turbidity which is selected from the group consisting of sodium chloride, potassium chloride, sodium bromide, potassium bromide, sodium iodide and potassium iodide.

36. The immersion bath of claim 35 wherein the salt is sodium chloride.

37. A concentrate in tablet or powder form which when mixed with water provides a non-toxic immersion bath for gold plating metallic items such as silver, copper, nickel, brass or gold alloys, or silver plated or gold plated metallic items, said tablet comprising effective amounts of: (1) a water soluble gold salt as a gold generating compound selected from the group consisting of potassium tetrachloroaurate, potassium tetrabromoaurate, potassium tetraiodoaurate, sodium tetrachloroaurate, sodium tetrabromoaurate, sodium tetraiodoaurate and sodium thiosulfatoaurate; (2) a reducing compound for said gold generating compound which is potassium sodium tartrate or tartaric acid; and (3) a salt selected from the group consisting of sodium chloride, potassium chloride, sodium bromide, potassium bromide, sodium iodide and potassium iodide.

38. The concentrate of claim 37 wherein the water soluble gold salt is potassium tetrachloroaurate, the reducing compound is potassium sodium tartrate and the salt is sodium chloride.

* * * * *